US007283101B2

(12) United States Patent
Bisiules et al.

(10) Patent No.: US 7,283,101 B2
(45) Date of Patent: Oct. 16, 2007

(54) ANTENNA ELEMENT, FEED PROBE; DIELECTRIC SPACER, ANTENNA AND METHOD OF COMMUNICATING WITH A PLURALITY OF DEVICES

(75) Inventors: Peter John Bisiules, LaGrange Park, IL (US); Ching-Shun Yang, Naperville, IL (US)

(73) Assignee: Andrew Corporation, Westchester, IL (US)

( * ) Notice: Subject to any disclaimer, the term of this patent is extended or adjusted under 35 U.S.C. 154(b) by 70 days.

(21) Appl. No.: 10/703,331

(22) Filed: Nov. 7, 2003

(65) Prior Publication Data

US 2004/0263392 A1 Dec. 30, 2004

Related U.S. Application Data

(60) Provisional application No. 60/482,689, filed on Jun. 26, 2003.

(51) Int. Cl.
*H01Q 21/00* (2006.01)

(52) U.S. Cl. ..... 343/727; 343/700 MS; 343/769; 343/797

(58) Field of Classification Search ..... 343/700 MS, 343/725, 727, 769, 797, 853, 893, 770
See application file for complete search history.

(56) References Cited

U.S. PATENT DOCUMENTS

| | | | | |
|---|---|---|---|---|
| 1,768,239 A | | 6/1930 | Englund | 343/728 |
| 2,942,263 A | | 6/1960 | Baldwin | |
| 3,290,684 A | | 12/1966 | Renn et al. | 342/381 |
| 3,887,926 A | * | 6/1975 | Schwartz et al. | 343/816 |
| 4,042,935 A | * | 8/1977 | Ajioka et al. | 343/795 |
| 4,184,163 A | | 1/1980 | Woodward | 343/742 |
| 4,320,402 A | | 3/1982 | Bowen | 343/700 MS |
| 4,434,425 A | | 2/1984 | Barbano | 343/797 |

(Continued)

FOREIGN PATENT DOCUMENTS

EP 0 817 310 A2 1/1998

(Continued)

OTHER PUBLICATIONS

"A Dual Band Circularly Polarised Microstrip Antenna With A Single Feed" 31st European Microwave Conference 2001, Conference Proceedings, Pt. vol. 3. pp. 329-332, vol. 3. London, UK, 2001—T Sudha and T S Vedavathy—Five (5) Pages.

(Continued)

*Primary Examiner*—Tho Phan
(74) *Attorney, Agent, or Firm*—Welsh & Katz, Ltd.

(57) ABSTRACT

A multiband base station antenna for communicating with a plurality of terrestrial mobile devices is described. The antenna including one or modules, each module including a low frequency ring element; and a high frequency dipole element superposed with the low frequency ring element. The element includes a ground plane; and a feed probe directed away from the ground plane and having a coupling part positioned proximate to the ring to enable the feed probe to electromagnetically couple with the ring. A dielectric clip provides a spacer between the feed probe and the ring, and also connects the ring to the ground plane. An antenna element is also described including a ring, and one or more feed probes extending from the ring, wherein the ring and feed probe(s) are formed from a unitary piece.

32 Claims, 18 Drawing Sheets

U.S. PATENT DOCUMENTS

| | | | | | |
|---|---|---|---|---|---|
| 4,516,133 | A | * | 5/1985 | Matsumoto et al. | 343/819 |
| 4,554,549 | A | | 11/1985 | Fassett et al. | 343/700 MS |
| 4,555,708 | A | * | 11/1985 | Waineo et al. | 343/799 |
| 4,987,421 | A | | 1/1991 | Sunahara et al. | 343/700 MS |
| 5,025,264 | A | | 6/1991 | Stafford | |
| 5,099,249 | A | | 3/1992 | Seavey | 343/700 MS |
| 5,323,168 | A | | 6/1994 | Itoh et al. | 343/700 MS |
| 5,343,211 | A | | 8/1994 | Kott | 342/379 |
| 5,502,453 | A | | 3/1996 | Tsukamoto et al. | |
| 5,519,406 | A | | 5/1996 | Tsukamoto et al. | |
| 5,548,297 | A | | 8/1996 | Arai | 343/700 MS |
| 5,745,079 | A | | 4/1998 | Wang et al. | 343/700 MS |
| 5,818,390 | A | * | 10/1998 | Hill | 343/700 MS |
| 5,838,282 | A | * | 11/1998 | Lalezari et al. | 343/727 |
| 6,054,953 | A | | 4/2000 | Lindmark | 343/700 MS |
| 6,078,297 | A | | 6/2000 | Kormanyos | |
| 6,166,708 | A | * | 12/2000 | Maury | 343/895 |
| 6,311,075 | B1 | | 10/2001 | Bevan et al. | 455/562.1 |
| 6,317,084 | B1 | | 11/2001 | Chen et al. | 343/700 MS |
| 6,333,720 | B1 | | 12/2001 | Gottl et al. | 343/810 |
| 6,429,819 | B1 | | 8/2002 | Bishop et al. | 343/725 |
| 6,507,316 | B2 | | 1/2003 | Mendelsohn et al. | 343/700 MS |
| 6,597,316 | B2 | * | 7/2003 | Rao et al. | 343/700 MS |
| 2003/0052825 | A1 | | 3/2003 | Rao et al. | 343/700 MS |
| 2003/0132893 | A1 | * | 7/2003 | Forster et al. | 343/895 |

FOREIGN PATENT DOCUMENTS

| | | | |
|---|---|---|---|
| EP | 1 130 675 | A2 | 9/2001 |
| EP | 1 072 065 | B1 | 3/2002 |
| JP | 03333666 | | 7/1993 |
| WO | WO99/21292 | | 4/1999 |
| WO | WO99/59223 | | 11/1999 |
| WO | WO 02/067376 | A1 | 8/2002 |
| WO | WO 02/071536 | A1 | 9/2002 |
| WO | WO 03/083992 | A1 | 10/2003 |

OTHER PUBLICATIONS

An Annular Ring Coupled To A Shorted Patch—May 5, 1997 IEEE Tranactions On Antennas And Propagation vol. 45 No. 5, May 1997—D. M. Kokotoff, R. B. Waterhouse and J. T. Aberle—pp. 913-914.

Ring Patch Antennas For Dual Frequency Use—Nachisa Goto and Kumiko Kaneta—Faculty of Engineering Tokyo Institute of Technology, Tokyo, Japan—1987 IEEE—pp. 994-997.

Nurie et al., "Concentric Ring Microstrip Antenna", *Microwave and Optical Technology Letters*, vol. 1:10 pp. 389-392 (1998).

Nurie et al., "Performance of Concentric Annular Patches as a Dual Frequency Band Microstrip Array Element", *IN: International Conference on Antennas and Propagation*, p. 144-148 (1989).

European Search Report; EP 04013840, No Dated.

Masayuki Nakano et al.: "Feed Circuits of Double-Layered Self-Diplexing Antenna For Mobile Satellite Communications" IEEE Transactions On Antennas And Propagation, IEEE Inc., New York, US, vol. 40, No. 10, Oct. 1, 1992, pp. 1269-1271, XP000336959 ISSN: 0018-926X.

Batchelor J C et al.: "Dual Mode And Stacked Concentric Ring Patch Antenna Arrays" Electronics Letters, IEE Stevenage, GB, vol. 29, No. 15, Jul. 22, 1993, pp. 1319-1320, XP000385650 ISSN: 0013-5194.

European Search Report; EP 1 494 313 A1, No Dated.

M.-J. Tsai and N. G. Alexopoulos, "Electromagenetically coupled microstrip ring-type antennas of arbitrary shape, "IEE Antennas and Propag. Soc. Int. Symp. pp. 684-687, Jul. 1995.

Joo Seong Jeon, Korea Telecom Freetel, "Design of wideband patch antennas for PCS and IMT-2000 service", *Microwave Journal*, Technical Feature, Jul. 2002.

D. M. Kokotoff, R. B. Waterhouse, and J. T. Aberle, "Analysis and design of probe-fed printed annular rings, "IEEE Antennas and Propagation Society International Symposium Digest. pp. 904-907, Jun. 1998.

Kokotoff D. M., J. T. Waterhouse Ro B, "Rigorous Analysis of Probe-Fed Printed Annular Ring Antennas", IEEE Transactions on Antennas and Propagation, vol. 47, No. 2, pp. 384-388, Feb. 1999.

A 10 GHz Integrated Class-E Oscillating Annular Ring Element for high-Efficiency Transmitting Arrays, (597KB) J.A. Hagerty, Z. Popovic', 2002 IEEE IMS Digest, pp. 1317-1320, Seattle, Jun. 2002.

"Annular Ring Antenna Array"(, Navastar, GPS Joint Program Office—Date; More than one (1) year prior to filing of application Serial No. 10703,331, No Dated.

Sudha T, Vedavathy T S, "A Dual band circularly polarized microstrip antenna with a single feed", Electrical Communication Engg. Dept., Indian Institute of Science, Bangalore, Inda.—Date: More than one (1) year prior to filing of application Serial No. 10/703,331, No Dated.

G. Parker, Y.M.M. Antar, A Ittipiboon and A. Petosa, *Invited* A Dual Polarized Microstip Ring Antenna with Good Isolation:, 1997 IEEE AP-S International Symposium and URSI North American Radio Science meeing, Montreal, Jul. 13-18, 1997.

Ramirez P R, De Flavis F, Alexopoulos N G, "Single-feed circularly polarized mircrostrip ring antenna and arrays", IEEE Transactions on Antennas and Propagation, vol. 48, No. 7, pp. 1040-1047, Jul. 2000.

Dual-band A-Panel Dual Polarization Half-power Beam Width Adjust. Electr. Downtilt, pp. 1-4, Kathrein-Werke KG—Date: More than one (1) year prior to filing of application Serial No. 10/703,331, No Dated.

Guo Yong-Xin, Luk Kwai-Man, Lee Kai-Fong, "L-Probe Proximity-Fed Annular Ring Microstrip Antennas", IEEE Transactions on Antennas and Propagation, vol. 49, No. 1 pp. 19-21, Jan. 2001.

Mak C L, Lee K M, Luk K M, Broadband patent antenna with a T-shaped probe, IEE Proce.—Microw. Antennas Propag., vol. 147, No. 2 pp. 73-76, Apr. 2000.

* cited by examiner

ANTENNA ELEMENT, FEED PROBE; DIELECTRIC SPACER, ANTENNA AND METHOD OF COMMUNICATING WITH A PLURALITY OF DEVICES

CROSS-REFERENCE TO RELATED APPLICATIONS

This application claims the benefit of priority from provisional patent application Ser. No. 60/482,689, filed Jun. 26, 2003, entitled Antenna Element, Multiband Antenna, And Method Of Communicating With A Plurality Of Devices. Provisional patent application Ser. No. 60/482,689, is incorporated herein by reference in its entirety

FIELD OF THE INVENTION

The present invention relates in its various aspects to an antenna element, a proximity-coupling feed probe for an antenna; a dielectric spacer for an antenna; an antenna (which may be single band or multiband), and a method of communicating with a plurality of devices. The invention is preferably but not exclusively employed in a base station antenna for communicating with a plurality of terrestrial mobile devices.

BACKGROUND OF THE INVENTION

In some wireless communication systems, single band array antennas are employed. However in many modern wireless communication systems network operators wish to provide services under existing mobile communication systems as well as emerging systems. In Europe GSM and DCS1800 systems currently coexist and there is a desire to operate emerging third generation systems (UMTS) in parallel with these systems. In North America network operators wish to operate AMPS/NADC, PCS and third generation systems in parallel.

As these systems operate within different frequency bands separate radiating elements are required for each band. To provide dedicated antennas for each system would require an unacceptably large number of antennas at each site. It is thus desirable to provide a compact antenna within a single structure capable of servicing all required frequency bands.

Base station antennas for cellular communication systems generally employ array antennas to allow control of the radiation pattern, particularly down tilt. Due to the narrow band nature of arrays it is desirable to provide an individual array for each frequency range. When antenna arrays are superposed in a single antenna structure the radiating elements must be arranged within the physical geometrical limitations of each array whilst minimising undesirable electrical interactions between the radiating elements.

US 2003/0052825 A1 describes a dual band antenna in which an annular ring radiates an omni-directional "doughnut" pattern for terrestrial communication capability, and an inner circular patch generates a single lobe directed towards the zenith at a desired SATCOM frequency.

WO 99/59223 describes a dual-band microstrip array with a line of three low frequency patches superposed with high frequency crossed dipoles. Additional high frequency crossed dipoles are also mounted between the low frequency patches. Parasitic sheets are mounted below the crossed dipoles.

Guo Yong-Xin, Luk Kwai-Man, Lee Kai-Fong, "*L-Probe Proximity-Fed Annular Ring Microstrip Antennas*", IEEE Transactions on Antennas and Propagation, Vol. 49, No. 1, pp 19–21, January 2001 describes a single band, single polarized antenna. The L-probe extends past the centre of the ring, so cannot be combined with other L-probes for a dual-polarized feed arrangement.

EXEMPLARY EMBODIMENT

A first aspect of an exemplary embodiment provides a multiband base station antenna for communicating with a plurality of terrestrial mobile devices, the antenna including one or more modules, each module including a low frequency ring element; and a high frequency element superposed with the low frequency ring element.

The high frequency element can be located in the aperture of the ring without causing shadowing problems. Furthermore, parasitic coupling between the elements can be used to control the high and/or low frequency beamwidth.

Preferably the low frequency ring element has a minimum outer diameter b, a maximum inner diameter a, and the ratio b/a is less than 1.5. A relatively low b/a ratio maximizes the space available in the center of the ring for locating the high band element, for a given outer diameter.

The antenna may be single polarized, or preferably dual polarized.

Typically the high frequency element and the low frequency ring element are superposed substantially concentrically, although non-concentric configurations may be possible.

Typically the high frequency element has an outer periphery, and the low frequency ring element has an inner periphery which completely encloses the outer periphery of the high frequency element, when viewed in plan perpendicular to the antenna. This minimizes shadowing effects.

The antenna can be used in a method of communicating with a plurality of terrestrial mobile devices, the method including communicating with a first set of said devices in a low frequency band using a ring element; and communicating with a second set of said devices in a high frequency band using a high frequency element superposed with the ring element.

The communication may be one-way, or preferably a two-way communication.

Typically the ring element communicates via a first beam with a first half-power beamwidth, and the high frequency element communicates via a second beam with a second half-power beamwidth which is no more than 50% different to the first beamwidth. This can be contrasted with US 2003/0052825 A1 in which the beamwidths are substantially different.

A further aspect of an exemplary embodiment provides a multiband antenna including one or more modules, each module including a low frequency ring element; and a dipole element superposed with the low frequency ring element. The antenna can be used in a method of communicating with a plurality of devices, the method including communicating with a first set of said devices in a low frequency band using a ring element; and communicating with a second set of said devices in a high frequency band using a dipole element superposed with the ring element.

We have found that a dipole element is particularly suited to being used in combination with a ring. The dipole element has a relatively low area (as viewed in plan perpendicular to the ring), and extends out of the plane of the ring, both of which may reduce coupling between the elements.

A further aspect of an exemplary embodiment provides an antenna element including a ring, and one or more feed probes extending from the ring, wherein the ring and feed probe(s) are formed from a unitary piece.

Forming as a unitary piece enables the ring and feed probe(s) to be manufactured easily and cheaply. Typically each feed probe meets the ring at a periphery of the ring. This permits the probe and ring to be easily formed from a unitary piece.

A further aspect of an exemplary embodiment provides an antenna element including a ring; and a feed probe having a coupling section positioned proximate to the ring to enable the feed probe to electromagnetically couple with the ring, wherein the coupling section of the feed probe has an inner side which cannot be seen within an inner periphery of the ring when viewed in plan perpendicular to the ring.

This aspect provides a compact arrangement, which is particularly suited for use in a dual polarized antenna, and/or in conjunction with a high frequency element superposed with the ring within its inner periphery. An electromagnetically coupled probe is preferred over a conventional direct coupled probe because the degree of proximity between the probe and the ring can be adjusted, to tune the antenna.

Typically the element further includes a second ring positioned adjacent to the first ring to enable the second ring to electromagnetically couple with said first ring. This improves the bandwidth of the antenna element.

A further aspect of an exemplary embodiment provides a dual polarized antenna element including a ring; and two or more feed probes, each feed probe having a coupling section positioned proximate to the ring to enable the feed probe to electromagnetically couple with the ring.

A further aspect of an exemplary embodiment provides an antenna feed probe including a feed section; and a coupling section attached to the feed section, the coupling section having first and second opposite sides, a distal end remote from the feed section; and a coupling surface which is positioned, when in use, proximate to an antenna element to enable the feed probe to electromagnetically couple with an antenna element, wherein the first side of the coupling section appears convex when viewed perpendicular to the coupling surface, and wherein the second side of the coupling section appears convex when viewed perpendicular to the coupling surface.

A probe of this type is particularly suited for use in conjunction with a ring element, the 'concavo-convex' geometry of the element enabling the element to align with the ring without protruding beyond the inner or outer periphery of the ring. In one example the coupling section is curved. In another, the coupling section is V-shaped.

A further aspect of an exemplary embodiment provides a multiband antenna including an array of two or more modules, each module including a low frequency ring element and a high frequency element superposed with the low frequency ring element.

The compact nature of the ring element enables the centres of the modules to be closely spaced, whilst maintaining sufficient space between the modules. This enables additional elements, such as interstitial high frequency elements, to be located between each pair of adjacent modules in the array. A parasitic ring may be superposed with each interstitial high frequency element. The parasitic ring(s) present a similar environment to the high band elements which can improve isolation as well as allowing the same impedance tuning for each high frequency element.

A further aspect of an exemplary embodiment provides a multiband antenna including one or more modules, each module including a low frequency ring element; and a high frequency element superposed with the low frequency ring element, wherein the low frequency ring element has a non-circular inner periphery.

The non-circular inner periphery can be shaped to ensure that sufficient clearance is available for the high frequency element, without causing shadowing effects. This enables the inner periphery of the ring to have a minimum diameter which is less than the maximum diameter of the high frequency element.

A further aspect of an exemplary embodiment provides a microstrip antenna including a ground plane; a radiating element spaced from the ground plane by an air gap; a feed probe having a coupling section positioned proximate to the ring to enable the feed probe to electromagnetically couple with the ring; and a dielectric spacer positioned between the radiating element and the feed probe.

This aspect can be contrasted with conventional proximity-fed microstrip antennas, in which the radiating element and feed probe are provided on opposite sides of a substrate. The size of the spacer can be varied easily, to control the degree of coupling between the probe and radiating element.

A further aspect of an exemplary embodiment provides a dielectric spacer including a spacer portion configured to maintain a minimum spacing between a feed probe and a radiating element; and a support portion configured to connect the radiating element to a ground plane, wherein the support portion and spacer portion are formed as a unitary piece.

Forming the spacer portion and support portion from a single piece enables the spacer to be manufactured easily and cheaply.

BRIEF DESCRIPTION OF THE DRAWINGS

The accompanying drawings which are incorporated in and constitute part of the specification, illustrate embodiments of the invention and, together with the general description of the invention given above, and the detailed description of the embodiments given below, serve to explain the principles of the invention.

DETAILED DESCRIPTION OF EMBODIMENTS OF THE INVENTION

Figure 1:
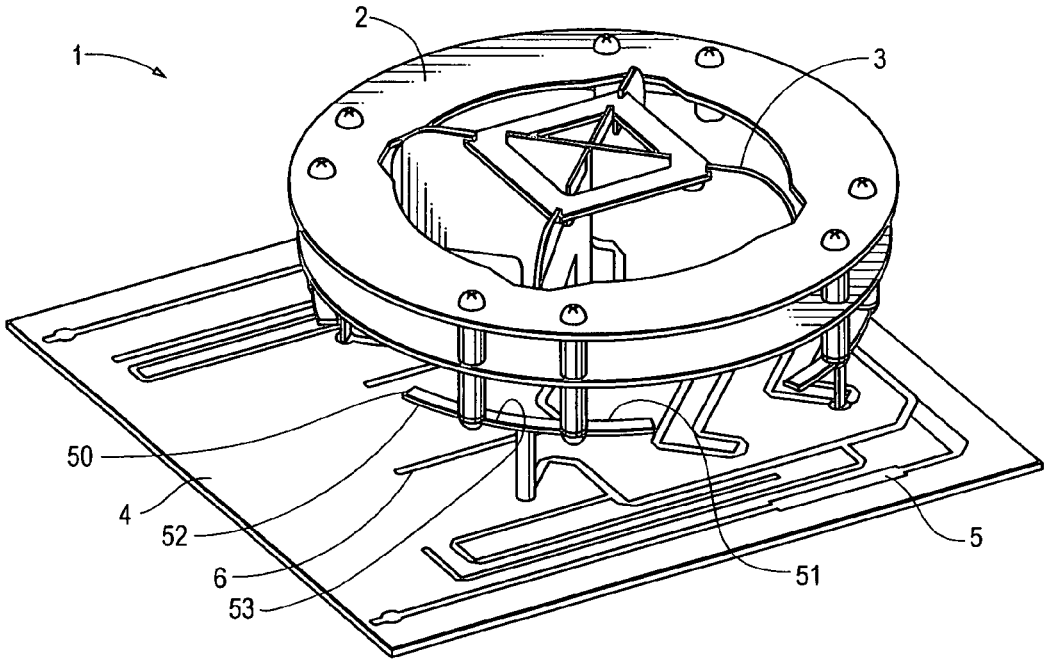
FIG. 1 shows a perspective view of a single antenna module.
Figure 1A:
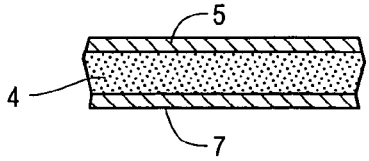
FIG. 1*a* shows a cross section through part of the PCB.

FIG. 1 shows a single antenna module 1, comprising a single low frequency Microstrip Annular Ring (MAR) 2 and a single high frequency Crossed Dipole Element (CDE) 3 centred in the MAR 2. The MAR 2 and CDE 3 are mounted on a printed circuit board (PCB). The PCB comprises a substrate 4 which carries a microstrip feedline network 5 coupled to the MAR 2, and a microstrip feedline network 6 coupled to the CDE 3. As shown in FIG. 1*a* (which is a cross section through part of the PCB), the other face of the substrate 4 carries a ground plane 7. The MAR 2 and CDE 3 are shown separately in FIGS. 2*a–c* and FIGS. 3*a–f* respectively.

Figure 2A:
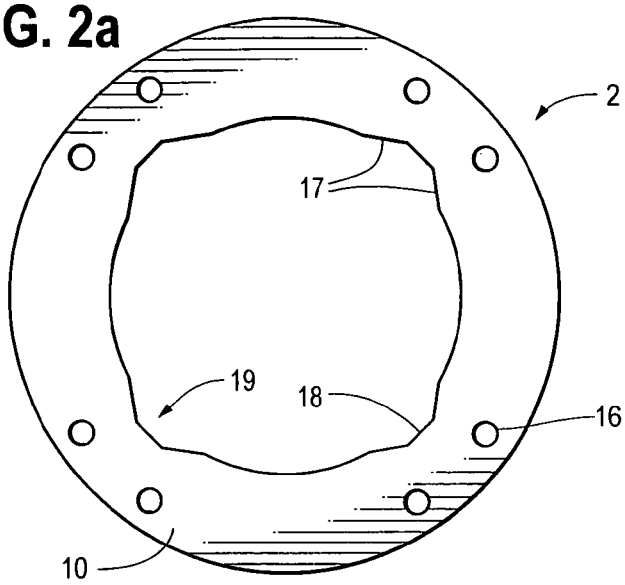
FIG. 2*a* shows a plan view of a Microstrip Annular Ring (MAR)
Figure 2B:
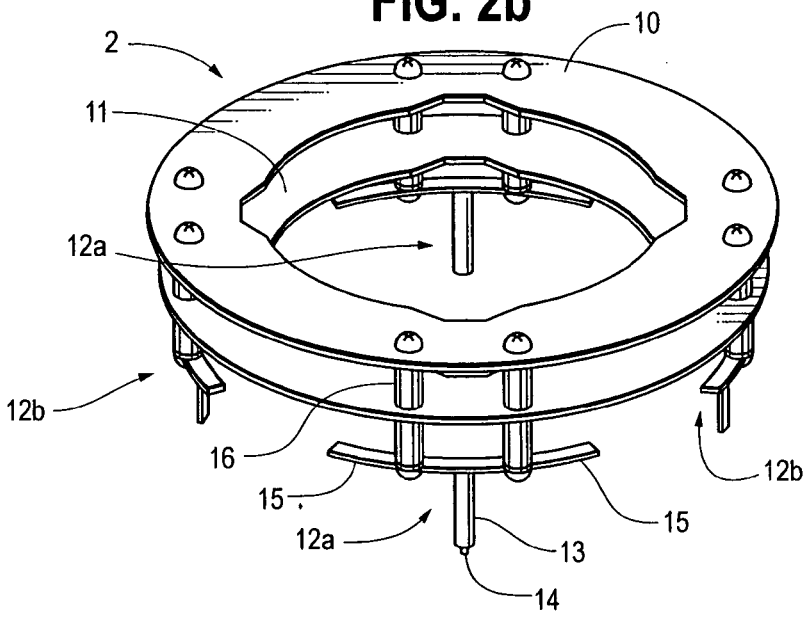
FIG. 2*b* shows a perspective view of the MAR.
Figure 2C:
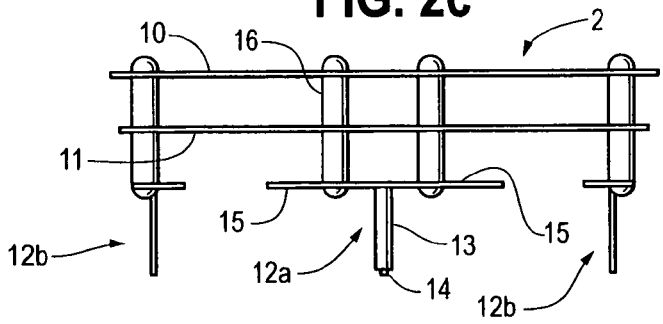
FIG. 2*c* shows a side view of the MAR.
Figure 3A:
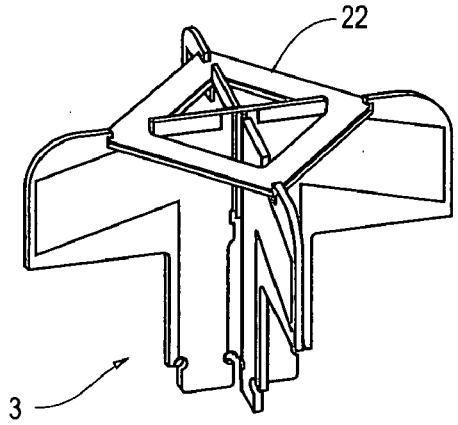
FIG. 3*a* shows a perspective view of a Crossed Dipole Element (CDE)
Figure 3B:
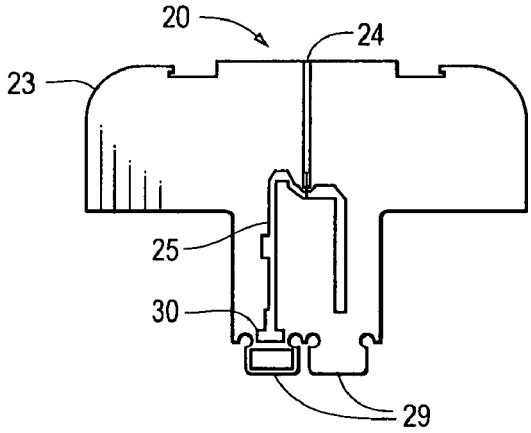
FIG. 3*b* shows a front view of a first dipole part.
Figure 3C:
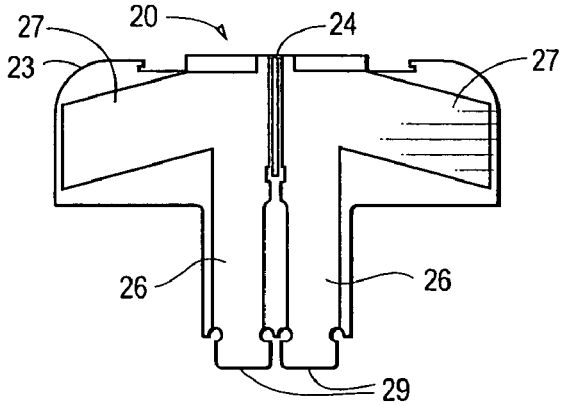
FIG. 3*c* shows a rear view of the first dipole part
Figure 3D:
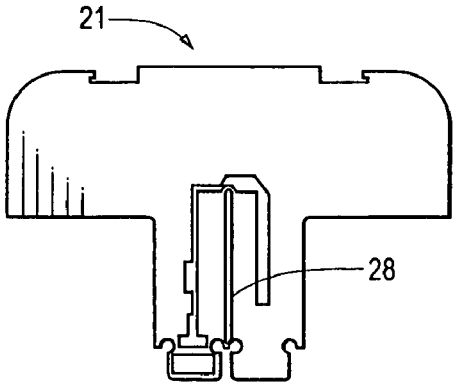
FIG. 3*d* shows a front view of a second dipole part.
Figure 3E:
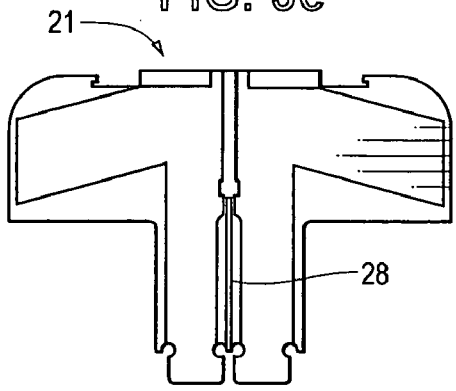
FIG. 3*e* shows a rear view of the second dipole part

Referring to FIGS. 2*a–c*, the MAR 2 comprises an upper ring 10, lower ring 11, and four T-probes 12*a*,12*b*. Each T-probe 12*a*,12*b* is formed from a single T-shaped piece of metal with a leg 13 and a pair of arms 15. The leg 13 is bent down by 90 degrees and is formed with a stub 14 which passes through a hole in the PCB and is soldered to the feed network 5. Thus the leg 13 and stub 14 together form a feed section, and the arms 15 together form a coupling section. Referring to FIG. 1, the arms 15 each have a distal end 50 remote from the feed section, an inner side 51 and an outer side 52, and an upper surface 53 which couples capacitively with the lower ring 11. The arms 15 extend circumferentially with respect to the ring, and have the same centre of curvature as the outer periphery of the lower ring 11. Therefore the outer sides 52 appear convex when viewed perpendicular to the upper surface 52, and the inner sides 51 appears convex when viewed perpendicular to the upper surface 52.

The arms 15 of the T-probe couple capacitively with the lower ring 11, which couples capacitively in turn with the upper ring 10. The rings 10,11 and the T-probes 12*a*,12*b* are separated by plastic spacers 16 which pass through apertures in the arms 15 of the T-probe and the lower ring 11. The spacers 16 are received in the apertures as a snap fit, and have a similar construction to the arms 122 described below with reference to FIG. 17.

The T-probes 12*a* are driven out of phase provide a balanced feed across the ring in a first polarization direction, and the T-probes 12*b* are driven out of phase to provide a balanced feed across the ring in a second polarization direction orthogonal to the first direction.

An advantage of using electromagnetically (or proximity) coupled feed probes (as opposed to direct coupled feed probes which make a direct conductive connection) is that the degree of coupling between the lower ring 11 and the T-probes can be adjusted for tuning purposes. This degree of coupling may be adjusted by varying the distance between the elements (by adjusting the length of the spacers 16), and/or by varying the area of the arms 15 of the T-probe.

It can be seen from FIGS. 1 and 2*c* that air gaps are present between the upper ring 10, the lower ring 11, the arms 15 of the T-probes and the PCB. In a first alternative proximity-coupling arrangement (not shown), the MAR may be constructed without air gaps, by providing a single ring as a coating on an outer face of a two-layer substrate. A proximity coupled microstrip stub feedline is provided between the two substrate layers, and a ground plane on the opposite outer face of the two-layer substrate. However the preferred embodiment shown in FIGS. 1 and 2*a*–2*c* has a number of advantages over this alternative embodiment. Firstly, there is an ability to increase the distance between the arms 15 of the T-probe and the lower ring 11. In the alternative embodiment this can only be achieved by increasing the substrate thickness, which cannot be increased indefinitely. Secondly, the rings 10 and 11 can be stamped from metal sheets, which is a cheap manufacturing method. Thirdly, because the legs 13 of the T-probes are directed away from the ground plane 7, the distance between the ground plane and the rings 10, 11 can easily be varied by adjusting the length of the legs 13. It has been found that the bandwidth of the antenna can be improved by increasing this distance.

In a second alternative proximity-coupled arrangement (not shown), the MAR may have a single ring 11, or a pair of stacked rings 10, 11, and the T-probes may be replaced by L-probes. The L-probes have a leg similar to the leg 13 of the T-probe, but only a single coupling arm which extends radially towards the centre of the ring. The second alternative embodiment shares the same three advantages as the first alternative embodiment. However, the use of radially extending L-probes makes it difficult to arrange a number of L-probes around the ring for a dual-polarized feed, due to interference between inner edges of the coupling arms. The inner parts of the L-probes would also reduce the volume available for the CDEs 3.

Note that the concave inner sides 51 of the arms of the T-probes cannot be seen within the inner periphery of the ring when viewed in plan perpendicular to the ring, as shown in FIG. 2*a*. This leaves this central volume (that is, the volume of projection of the inner periphery of the ring, projected onto the ground plane) free to accommodate the CDE. It also ensures that the T-probes are spaced apart to minimize interference.

The "concavo-convex" shape of the arms 15 of the T-probes conforms to the shape of the lower ring, thus maximising the coupling area whilst leaving the central volume free.

The upper ring 10 has a larger outer diameter than the lower ring 11 (although in an alternative embodiment it could be smaller). However the inner diameter, and shape, of each of the rings, is the same. Specifically, the inner periphery of the rings is circular with four notches 19 formed at 90 degree intervals. Each notch has a pair of straight angled sidewalls 17 and a base 18. As can be seen in the FIG. 1, and the plan view of FIG. 6*a*, the diameter of the CDE 3 is greater than the minimum inner diameter of the rings. The provision of notches 19 enables the inner diameter of the rings to be minimised, whilst providing sufficient clearance for the arms of the CDE 3. Minimising the inner diameter of the rings provides improved performance, particularly at high frequencies.

The lower ring 11 has a minimum outer diameter b, a maximum inner diameter a, and the ratio b/a is approximately 1.36. The upper ring 12 has a minimum outer diameter b', a maximum inner diameter a', and the ratio b'/a' is approximately 1.40. The ratios may vary but are typically lower than 10, preferably less than 2.0, and most preferably less than 1.5. A relatively low b/a ratio maximizes the central volume available for locating the CDE.

Referring to FIGS. 3*a–e*, the CDE 3 is formed in three parts: namely a first dipole part 20, a second dipole part 21, and a plastic alignment clip 22. The first dipole part comprises an insulating PCB 23 formed with a downwardly extending slot 24. The front of the PCB 23 carries a stub feedline 25 and the back of the PCB 23 carries a dipole radiating element comprising a pair of dipole legs 26 and arms 27. The second dipole part 21 is similar in structure to the first dipole part 20, but has an upwardly extending slot 28. The CDE 3 is assembled by slotting together the dipole parts 20, 21, and mounting the clip 22 to ensure the dipole parts remain locked at right-angles.

The PCB 23 has a pair of stubs 29 which are inserted into slots (not shown) in the PCB 4. The feedline 25 has a pad 30 formed at one end which is soldered to the microstrip feedline network 6.

The small footprint of the MAR 2 prevents shadowing of the CDE 3. By centring the CDE 3 in the MAR 2, a symmetrical environment is provided which leads to good port-to-port isolation for the high band. The MAR is driven in a balanced manner, giving good port-to-port isolation for the low band.

Figure 4:
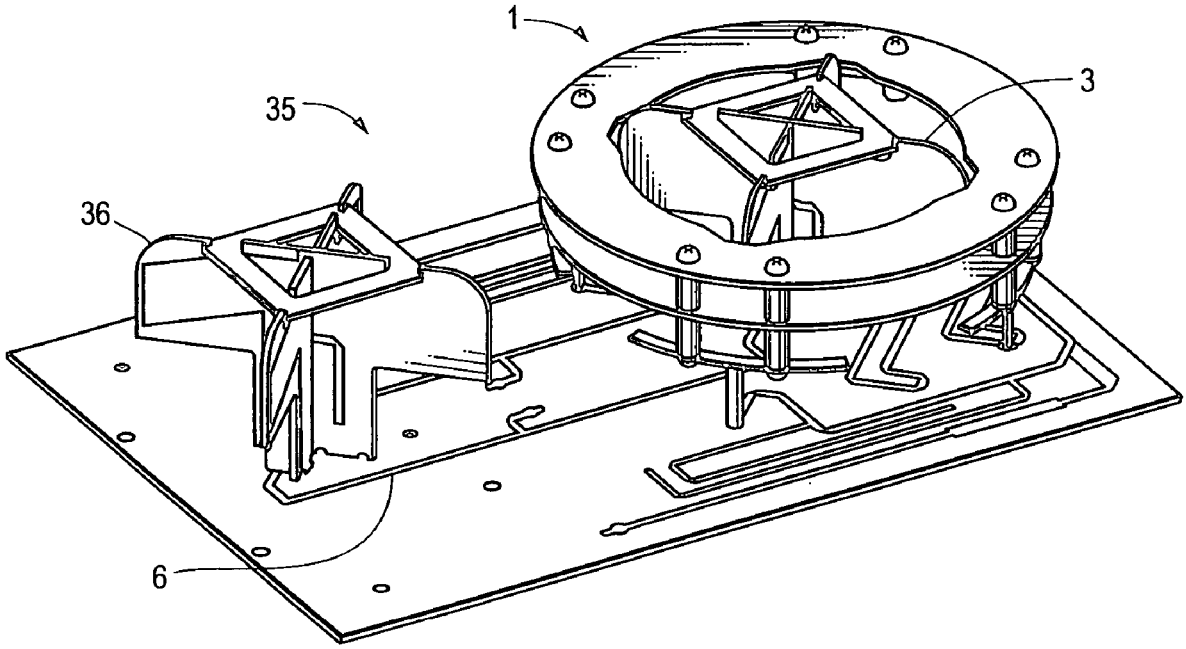
FIG. 4 shows a perspective view of a dual module.

A dual antenna module 35 is shown in FIG. 4. The dual module 35 includes a module 1 as shown in FIG. 1. An additional high frequency CDE 36 is mounted next to the module 1. The microstrip feedline network 6 is extended as shown to feed the CDE 36. The CDE 36 may be identical to the CDE 3. Alternatively, adjustments to the resonant dimensions of the CDE 36 may be made for tuning purposes (for instance adjustments to the dipole arm length, height etc).

Figure 5:
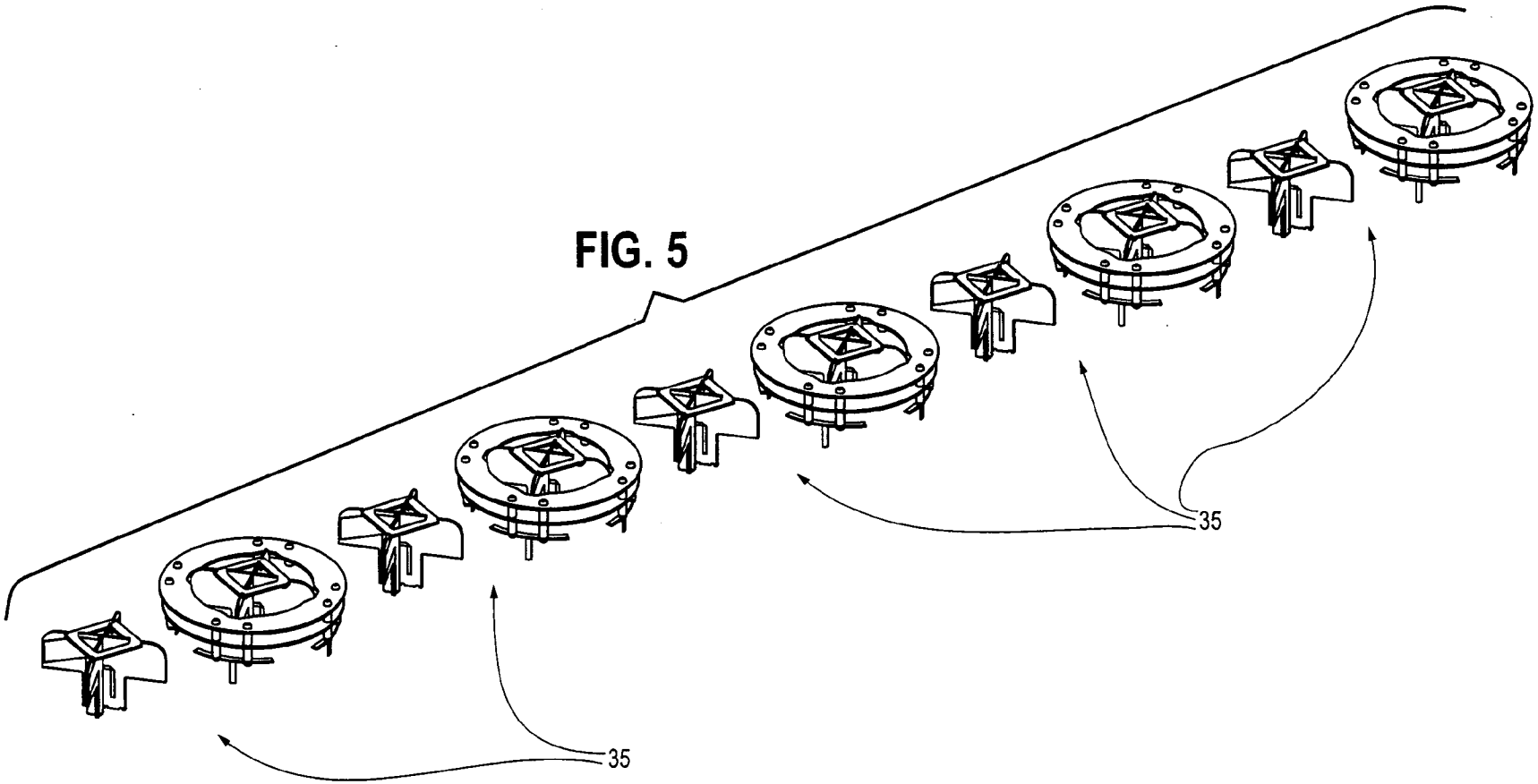
FIG. 5 shows a perspective view of an antenna array.

An antenna for use as part of a mobile wireless communications network in the interior of a building may employ only a single module as shown in FIG. 1, or a dual module as shown in FIG. 4. However, in most external base station applications, an array of the form shown in FIG. 5 is preferred. The array of FIG. 5 comprises a line of five dual modules 35, each module 35 being identical to the module shown in FIG. 4. The PCB is omitted in FIG. 5 for clarity. The feedlines are similar to feedlines 5, 6, but are extended to drive the modules together.

Different array lengths can be considered based on required antenna gain specifications. The spacing between the CDEs is half the spacing between the MARs, in order to maintain array uniformity and to avoid grating lobes.

The modules 35 are mounted, when in use, in a vertical line. The azimuth half-power beamwidth of the CDEs would be 70–90 degrees without the MARs. The MARs narrow the azimuthal half-power beamwidth of the CDEs to 50–70 degrees.

Figure 6A:
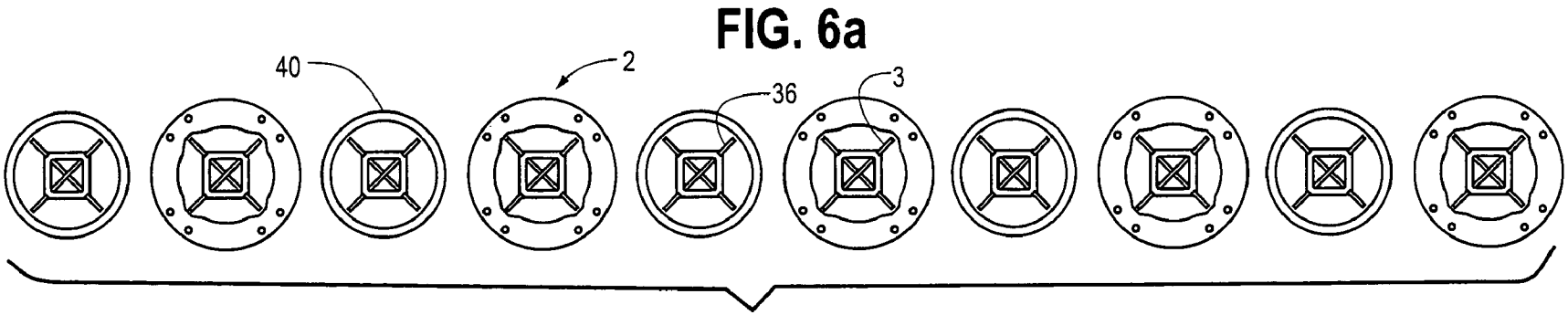
FIG. 6*a* shows a plan view of an antenna array with parasitic rings.
Figure 6B:
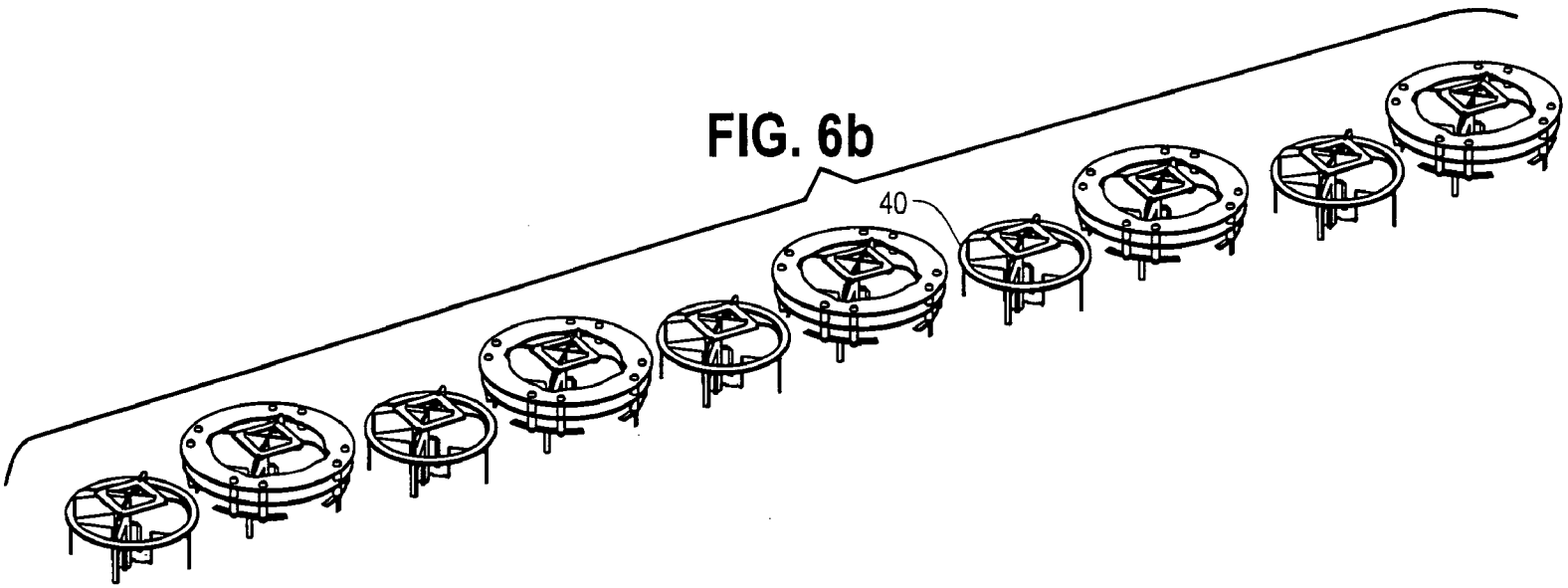
FIG. 6*b* shows a perspective view of the array of FIG. 6*a;*
Figure 7A:
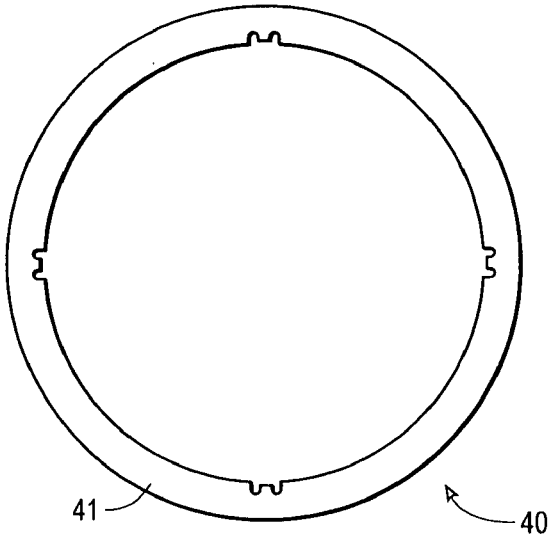
FIG. 7*a* shows a plan view of a parasitic ring.
Figure 7B:
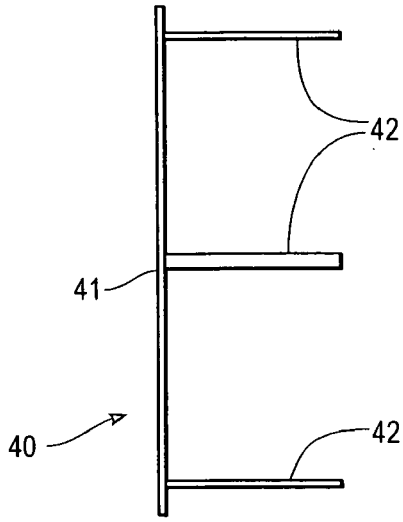
FIG. 7*b* shows a side view of the parasitic ring.
Figure 7C:
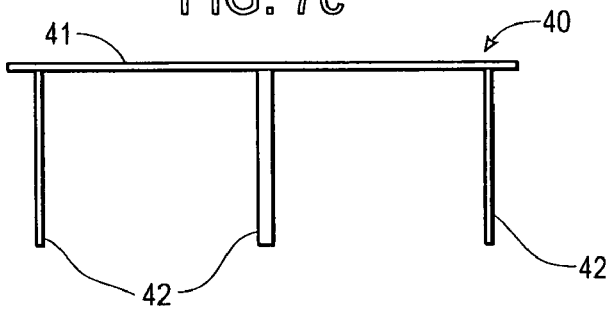
FIG. 7*c* shows an end view of the parasitic ring
Figure 7D:
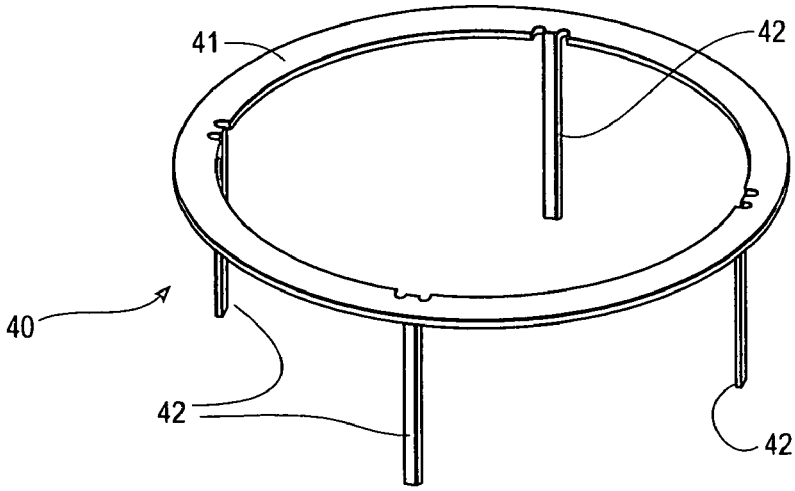
FIG. 7*d* shows a perspective view of the parasitic ring

An alternative antenna array is shown in FIGS. 6*a* and 6*b*. The array is identical to the array shown in FIG. 5, except that additional parasitic rings 40 have been added. One of the parasitic rings 40 is shown in detail in FIGS. 7*a–d*. The ring 40 is formed from a single piece of stamped sheet metal, and comprises a circular ring 41 with four legs 42. A recess (not labelled) is formed in the inner periphery of the ring where the ring meets each leg 42. This enables the legs 42 to be easily bent downwardly by 90 degrees into the configuration shown. The legs 42 are formed with stubs (not labelled) at their distal end, which are received in holes (not shown) in the PCB. In contrast to the legs 13 of the T-probes, the legs 42 of the parasitic rings 40 are not soldered to the feed network 5, although they may be soldered to the ground plane 7. Hence the rings 40 act as "parasitic" elements. The provision of the parasitic rings 40 means that the environment surrounding the CDEs 36 is identical, or at least similar, to the environment surrounding the CDEs 3. The outer diameter of the parasitic rings 40 is smaller than the outer diameter of the MARs in order to fit the parasitic rings into the available space. However, the inner diameters can be similar, to provide a consistent electromagnetic environment.

Figure 8:
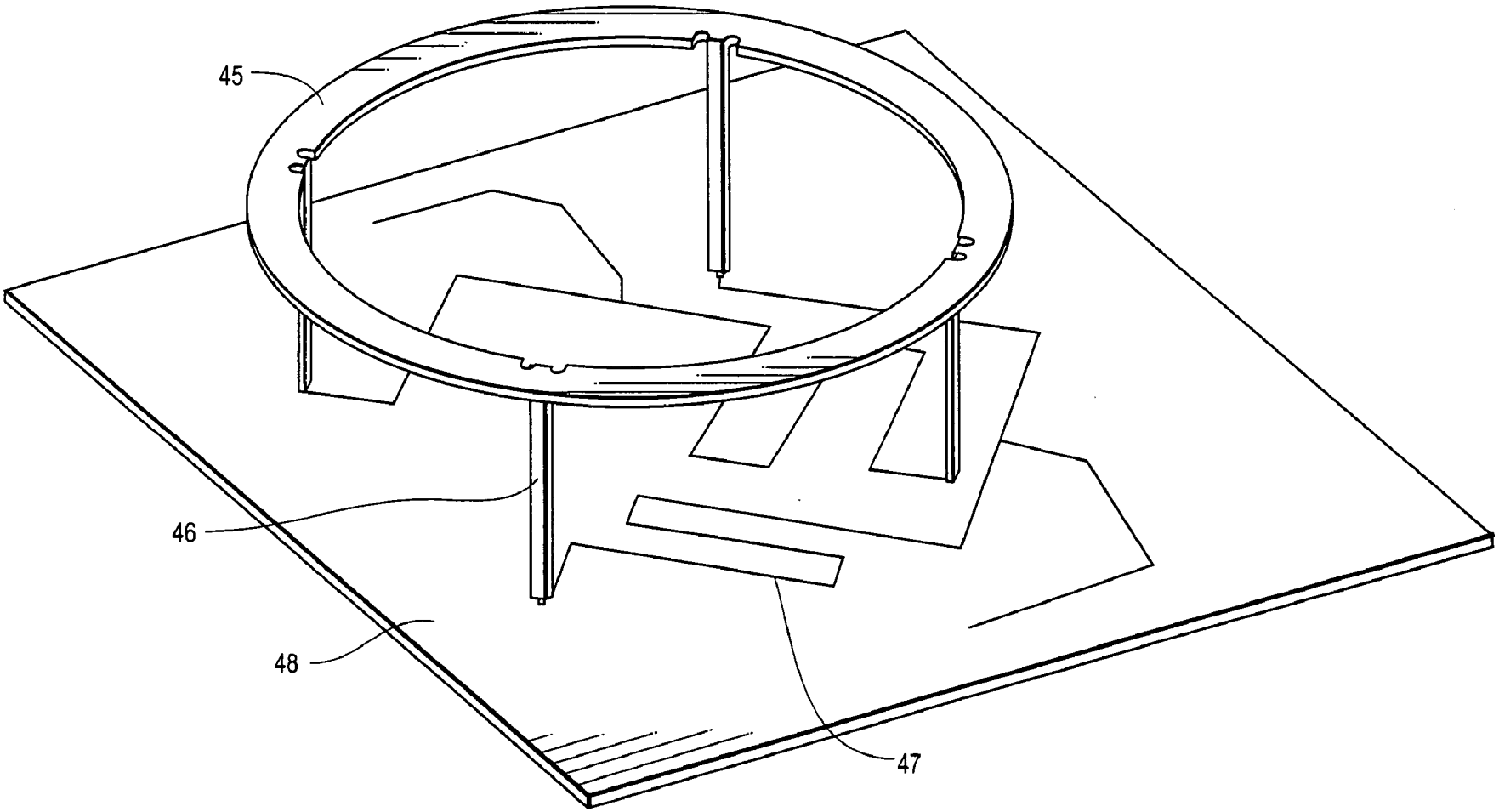
FIG. 8 shows a perspective view of an antenna employing a single piece radiating element.

An alternative antenna is shown in FIG. 8. The antenna includes a singe piece radiating ring 45 (identical in construction to the parasitic ring 40 shown in FIG. 7*a–7d*). The legs 46 of the ring are coupled to a feed network 47 on a PCB 48. In contrast to the rings 40 in FIGS. 6*a* and 6*b* (which act as parasitic elements), the ring 45 shown in FIG. 8 is coupled directly to the feed network and thus acts as a radiating element.

An air gap is provided between the ring 45 and the PCB 48. In an alternative embodiment (not shown), the air gap may be filled with dielectric material.

Figure 9A:
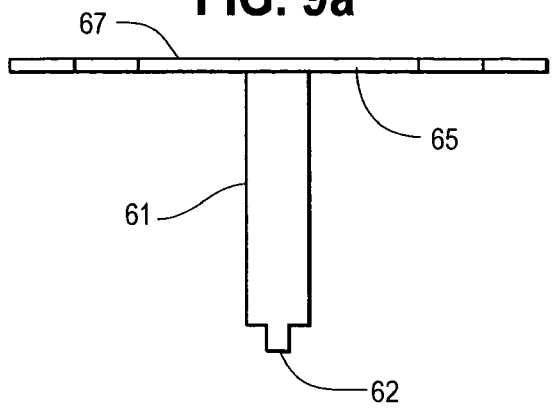
FIG. 9A shows an end view of an alternative probe.
Figure 9B:
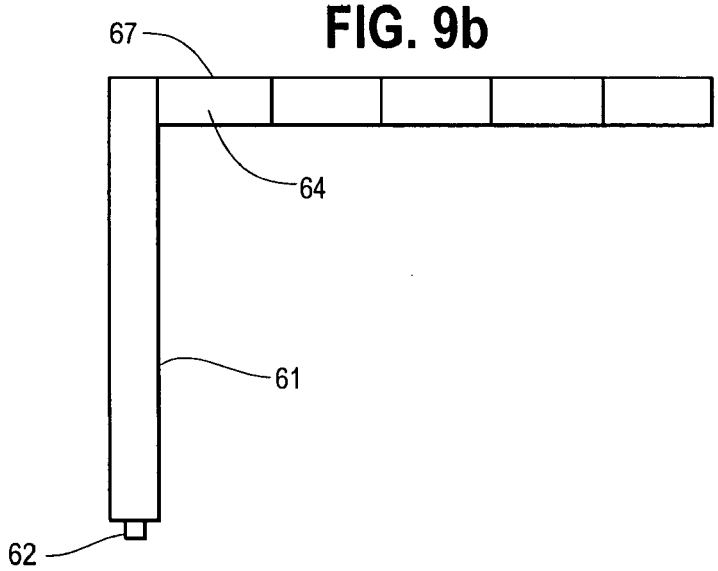
FIG. 9B shows a side view of the probe.
Figure 9C:
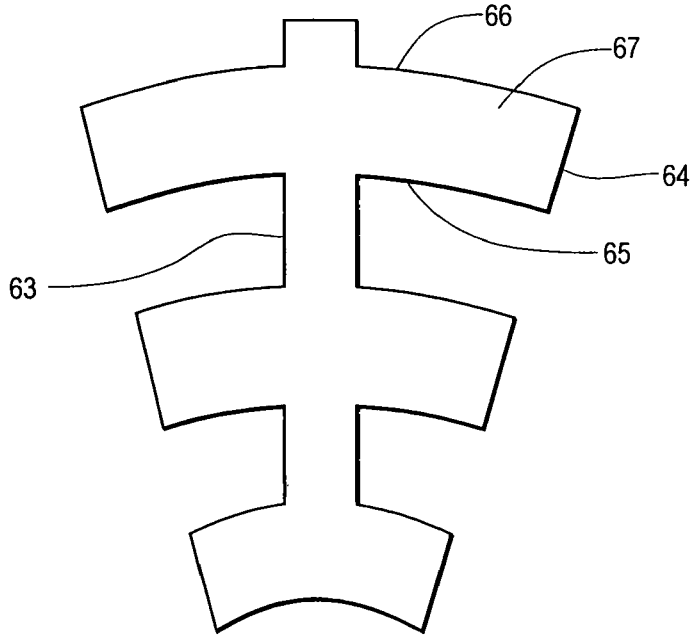
FIG. 9C shows a plan view of the probe.

An alternative electromagnetic probe 60 is shown in FIGS. 9A–9C. The probe 60 can be used as a replacement to the T-probes shown in FIGS. 1 and 2. The probe 60 has a feed section formed by a leg 61 with a stub 62, and an arm 63 bent at 90 degrees to the leg 61. Extending from the arm 63 are six curved coupling arms, each arm having a distal end 64, a concave inner side 65, a convex outer side 66, and a planar upper coupling surface 67. Although six coupling arms are shown in FIGS. 9A–9C, in an alternative embodiment only four arms may be provided. In this case, the probe would appear H-shaped in the equivalent view to FIG. 9C.

Figure 10:
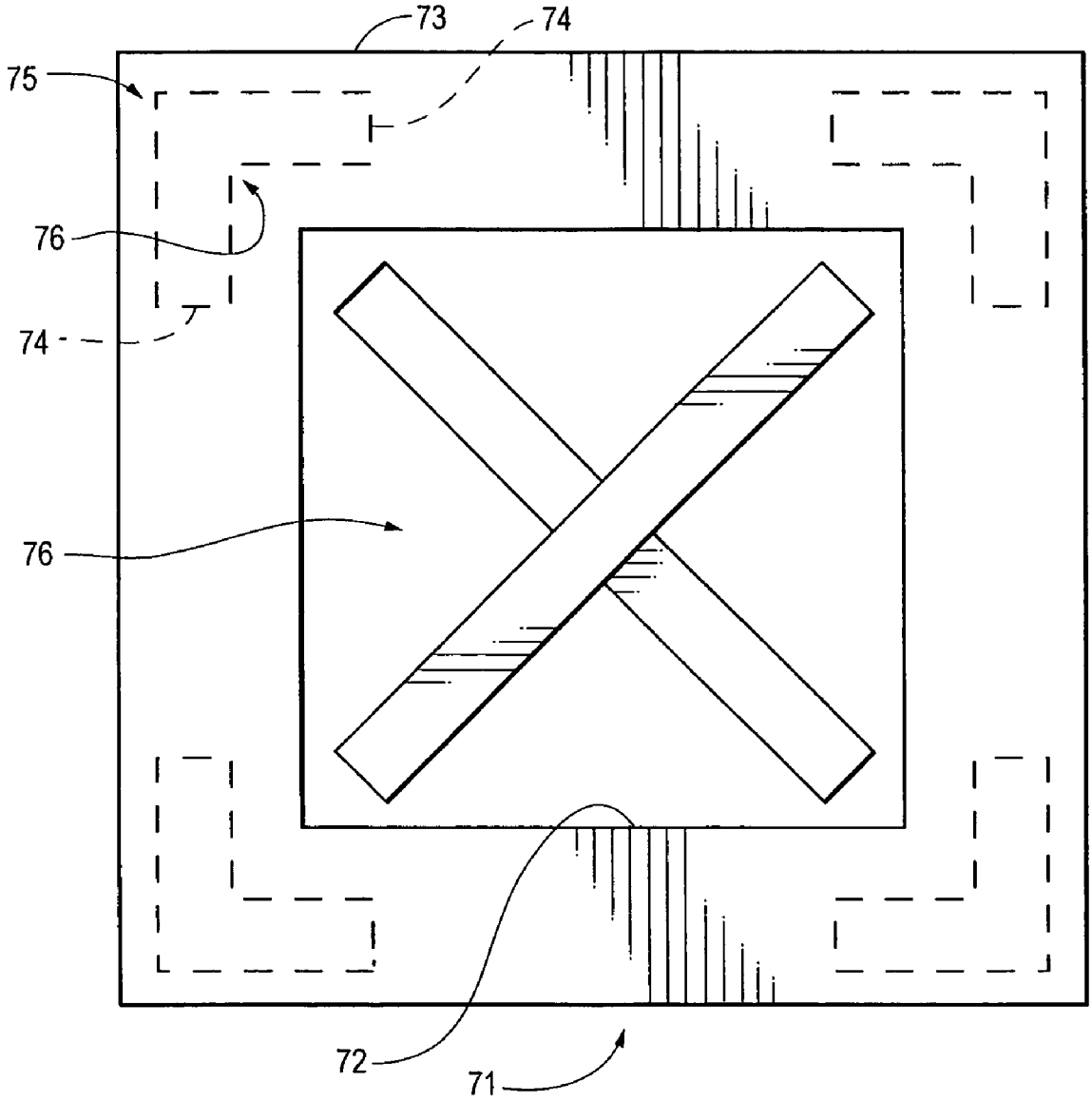
FIG. 10 shows a plan view of a square MAR.

An alternative antenna module 70 is shown in FIG. 10. In contrast to the circular MAR of FIG. 1, the module 70 has a square MAR 71 with a square inner periphery 72 and a square outer periphery 73. The T-probes shown in the embodiment of FIGS. 1 and 2 are replaced by T-probes formed with a feed leg (not shown) and a pair of arms 74 extending from the end of the feed leg. The arms 74 are straight, and together form a V-shape with a concave outer side 75 and a convex inner side 76. A CDE 76 (identical to the CDE 3 of FIG. 1) is superposed concentrically with the ring 61, and its arms extend into the diagonal corners of the square inner periphery 72.

Figure 11:
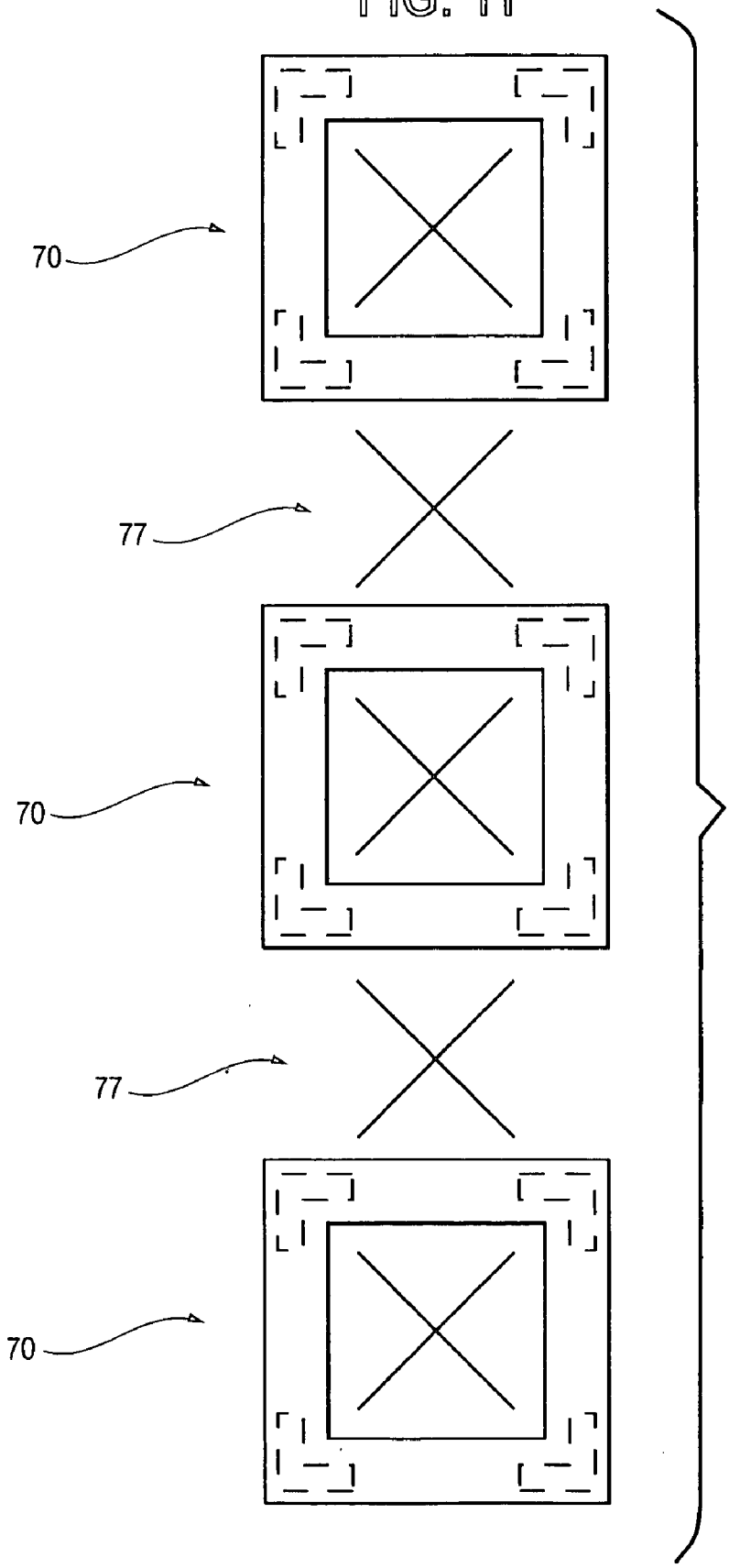
FIG. 11 shows an antenna array incorporating square MARs.

An antenna formed from an array of modules 70 is shown in FIG. 11. Interstitial high band CDEs 77 are provided between the modules 70. Although only three modules are shown in FIG. 11, any alternative number of modules may be used (for instance five modules as in FIG. 5).

Figure 12:
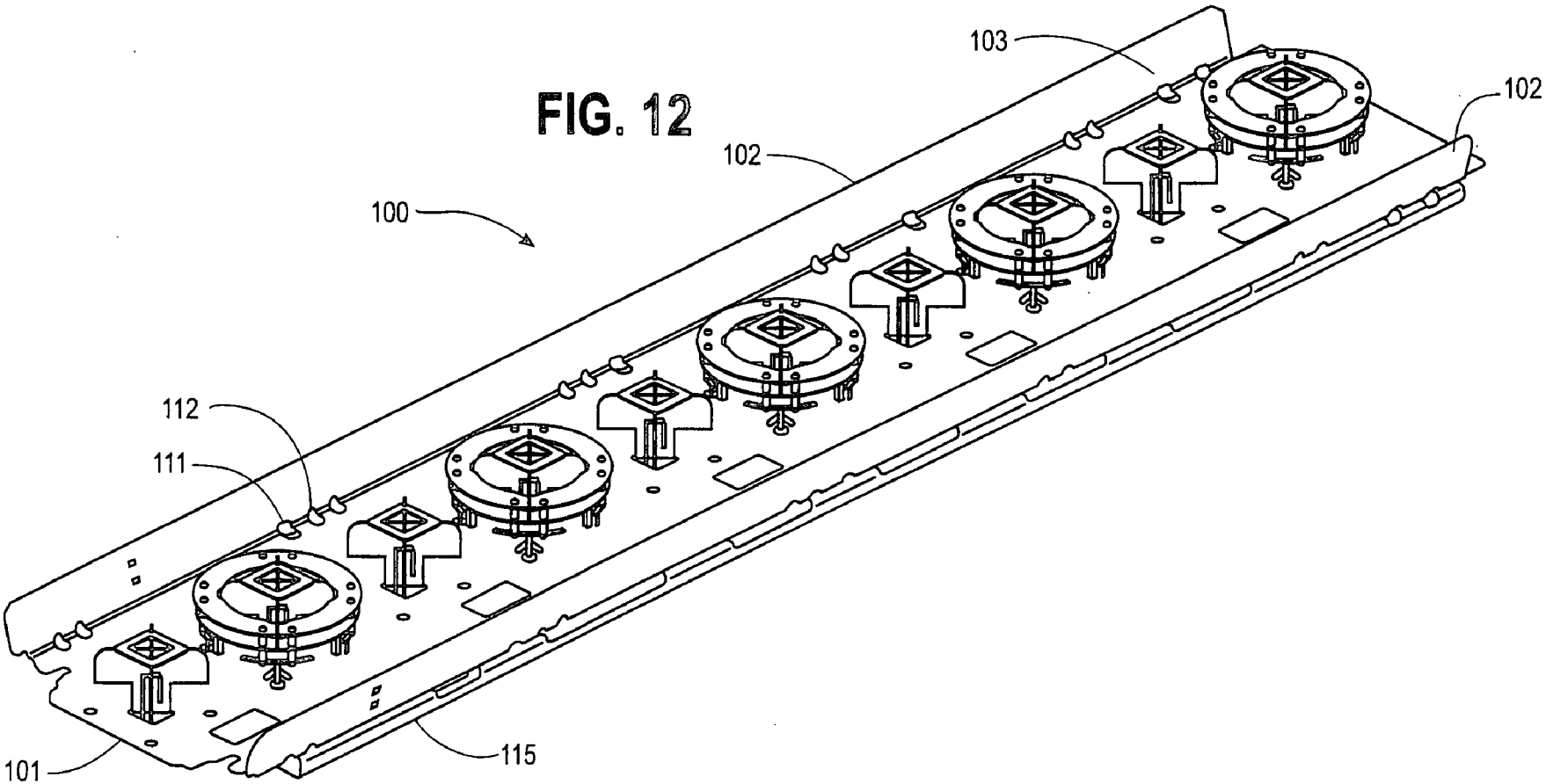
FIG. 12 shows an isometric view of an antenna.
Figure 13:
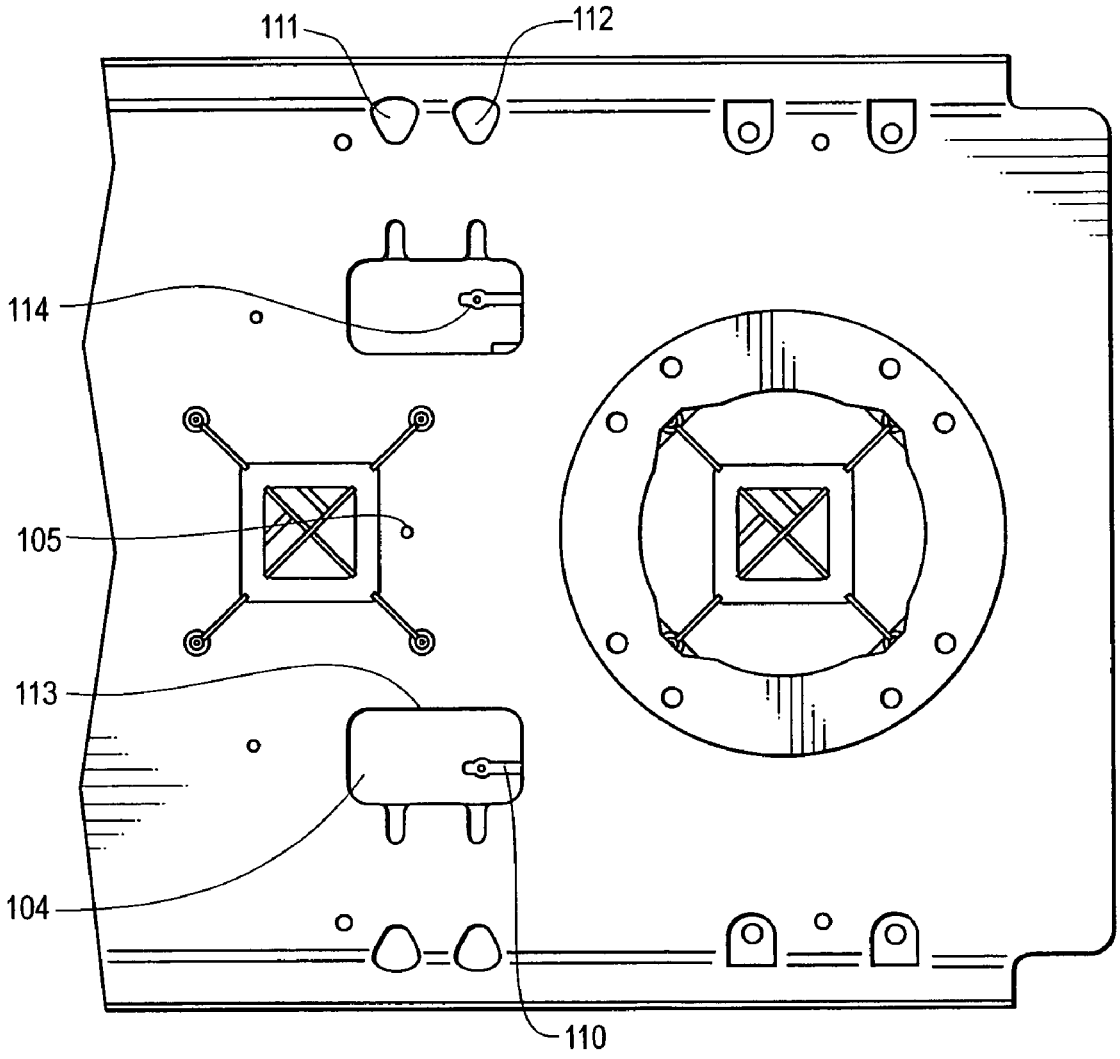
FIG. 13 shows a plan view of one end of the antenna.
Figure 14:
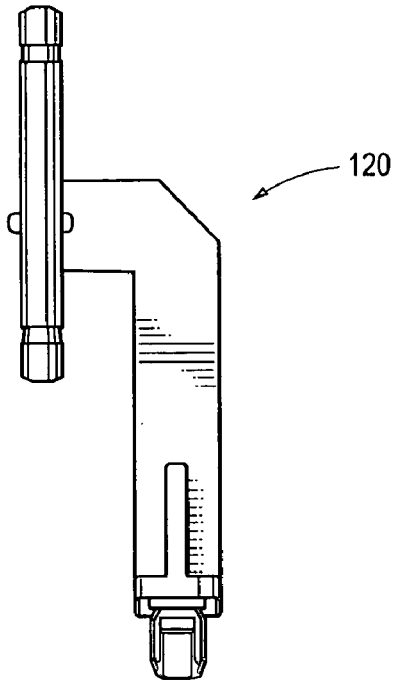
FIG. 14 shows an end view of a clip.

An alternative multiband antenna 100 is shown in FIGS. 12 and 13. In common with the antenna of FIG. 5, the antenna 100 provides broadband operation with low intermodulation and the radiating elements have a relatively small footprint. The antenna 100 can be manufactured at relatively low cost.

A sheet aluminium tray provides a planar reflector 101, and a pair of angled side walls 102. The reflector 101 carries five dual band modules 103 on its front face, and a PCB 104 on its rear face (not shown). The PCB is attached to the rear face of the reflector 101 by plastic rivets (not shown) which pass through holes 105 in the reflector 101. Optionally the PCB may also be secured to the reflector with double sided tape. The front face of the PCB, which is in contact with the rear face of the reflector 101, carries a continuous copper ground plane layer. The rear face of the PCB carries a feed network (not shown).

Coaxial feed cables (not shown) pass through cable holes 111,112 in the side walls 102 and cable holes 113 in the reflector 101. The outer conductor of the coaxial cable is soldered to the PCB copper ground plane layer. The central conductor passes through a feed hole 114 in the PCB through to its rear side, where it is soldered to a feed trace. For illustrative purposes, one of the feed traces 110 of the feed network can be seen in FIG. 13. Note however that in practice the feed trace 110 would not be visible in the plan view of FIG. 13 (since it is positioned on the opposite face of the PCB).

Phase shifters (not shown) are mounted on a phase shifter tray 115. The tray 115 has a side wall running along the length of each side of the tray. The side walls are folded into a C shape and screwed to the reflector 101.

In contrast to the arrangement of FIGS. 1, 4 and 8 (in which the feed network faces the radiating elements, with no intervening shield), the reflector 101 and PCB copper ground plane provide a shield which reduces undesirable coupling between the feed network and the radiating elements.

Each dual band module 103 is similar to the module 35 shown in FIG. 4, so only the differences will be described below.

The annular rings and T-probe of the MAR are spaced apart and mounted to the reflector by four dielectric clips 120, one of the clips 120 being shown in detail in FIGS. 14–18.

Figure 15:
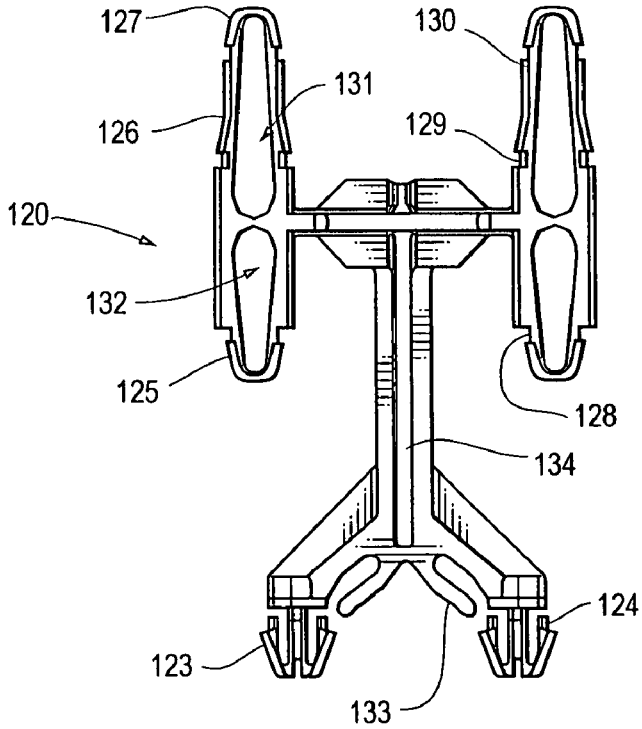
FIG. 15 shows a side view of the clip.
Figure 16:
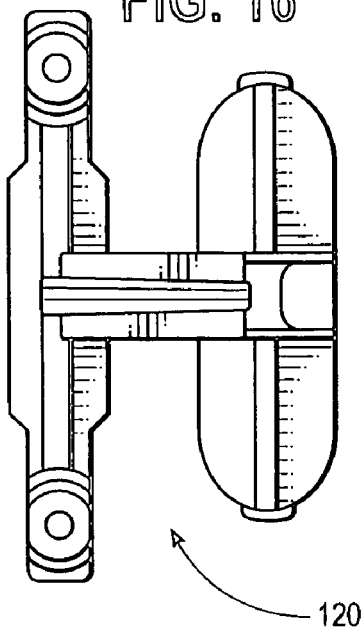
FIG. 16 shows a plan view of the clip.
Figure 17:
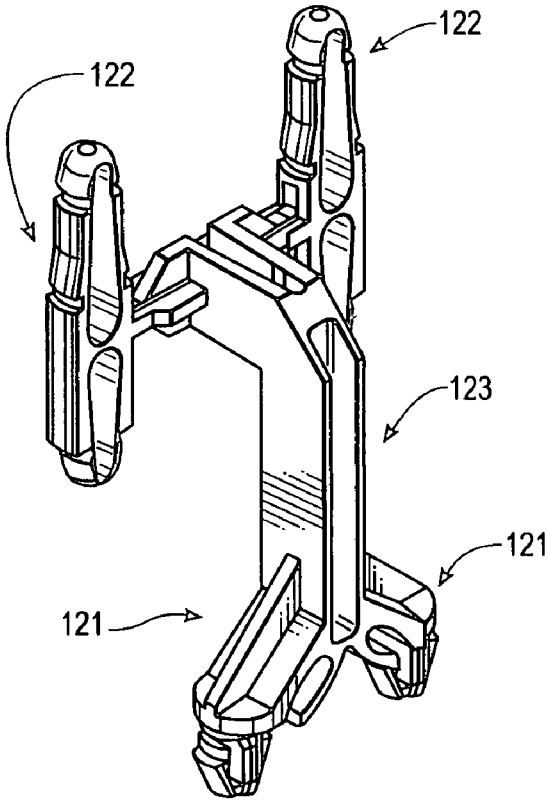
FIG. 17 shows a first isometric view of the clip.
Figure 18:
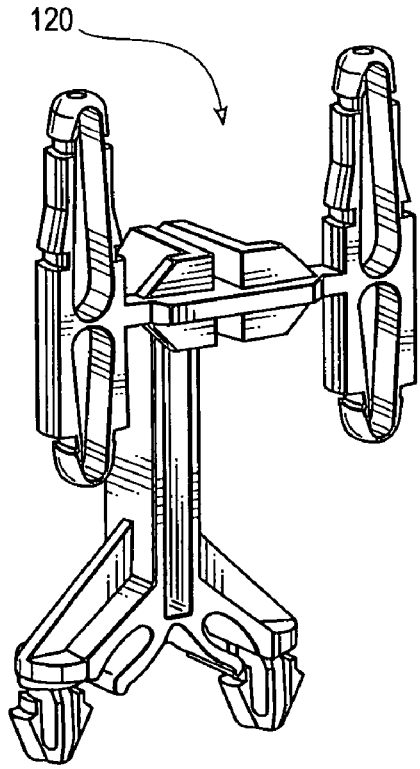
FIG. 18 shows a second isometric view of the clip.

Referring first to the perspective view of FIG. 17, the clip 120 has a pair of support legs 121, a pair of spacer arms 122, and an L-shaped body portion 123. Referring to FIG. 15, the end of each support leg 121 carries a pair of spring clips 123, each spring clip having a shoulder 124. Each spacer arm 122 has a pair of lower, central and upper grooves 128, 129, and 130 respectively. A pair of lower, central and upper frusto-conical ramps 125, 126 and 127 are positioned next to each pair of grooves. Each arm also has a pair of openings 131,132 which enable the ramps 128–130 to flex inwardly. A pair of leaf springs 133 extend downwardly between the legs 121. The clip 120 is formed as a single piece of injection moulded Delrin™ acetal resin. The body portion 123 is formed with an opening 134 to reduce wall thickness. This assists the injection moulding process.

Figure 19:
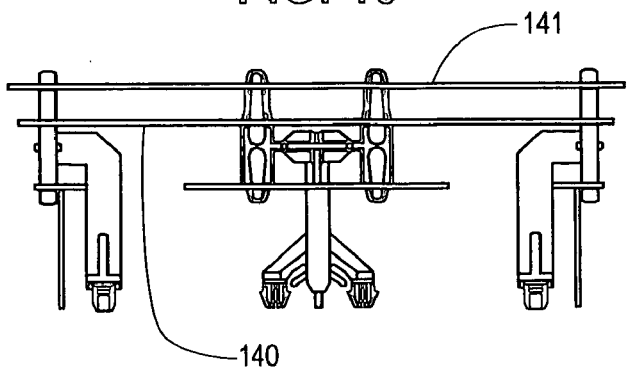
FIG. 19 shows a side view of an MAR.
Figure 20:
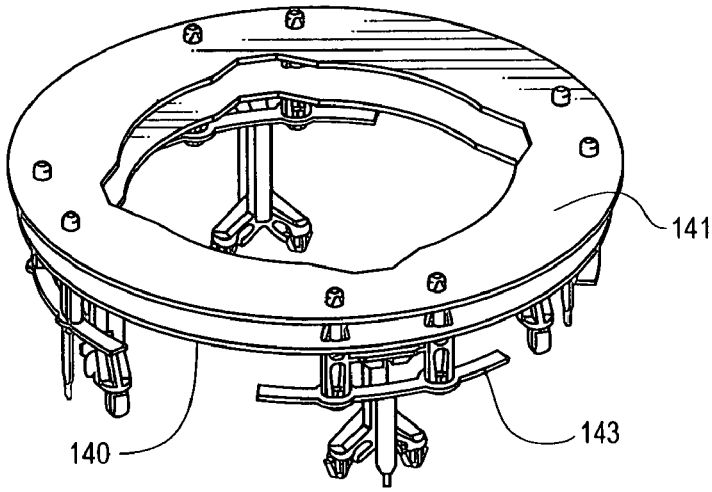
FIG. 20 shows a top isometric view of the MAR.
Figure 21:
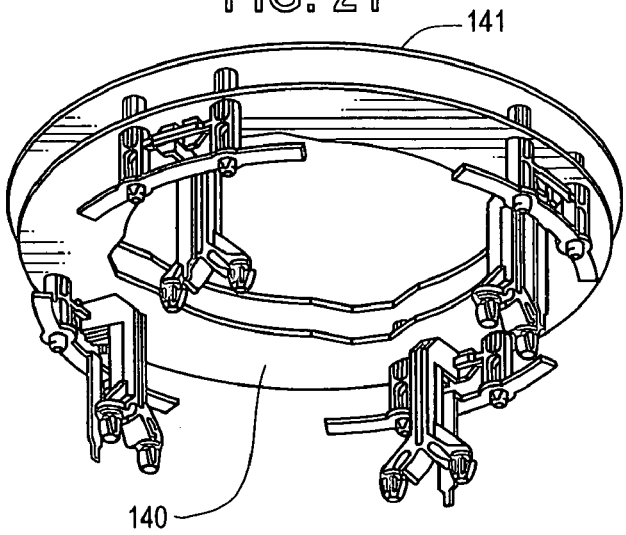
FIG. 21 shows a bottom isometric view of the MAR.

Each module 103 includes an MAR shown in detail in FIGS. 19–21. Note that for clarity the CDE is omitted from FIGS. 19–21. The MAR is assembled as follows.

Each T-probe is connected to a respective clip by passing the spacer arms through a pair of holes (not shown) in the T-probe. The lower ramps 125 of the spacer arms 122 flex inwardly and snap back to hold the T-probe securely in the lower groove 128

The MAR includes a lower ring 140 and upper ring 141. Each ring has eight holes (not shown). The holes in the lower ring 140 are larger than the holes in the upper ring 141. This enables the upper ramps 127 of the spacer arm to pass easily through the hole in the lower ring. As the lower ring 140 is pushed down onto the spacer arm, the sides of the hole engage the central ramps 126 which flex inwardly, then snap back to hold the ring securely in the central grooves 129. The upper ring 141 can then be pushed down in a similar manner into upper grooves 130, past ramp 127 which snaps back to hold the upper ring securely in place After assembly, the MAR is mounted to the panel by snap fitting the support legs 121 of each clip into holes (not shown) in the reflector 101, and soldering the T-probes 143 to the feed network. When the spring clips 123 snap back into place, the reflector 101 is held between the shoulder 124 of the spring clip and the bottom face of the leg 121. Any slack is taken up by the action of the leaf springs 133, which apply a tension force to the reflector 101, pressing the shoulder 124 against the reflector.

The clips 120 are easy to manufacture, being formed as a single piece. The precise spacing between the grooves 128–130 enables the distance between the elements to be controlled accurately. The support legs 121 and body portion 123 provide a relatively rigid support structure for the elements, and divert vibrational energy away from the solder joint between the T-probe and the PCB.

Figure 22:
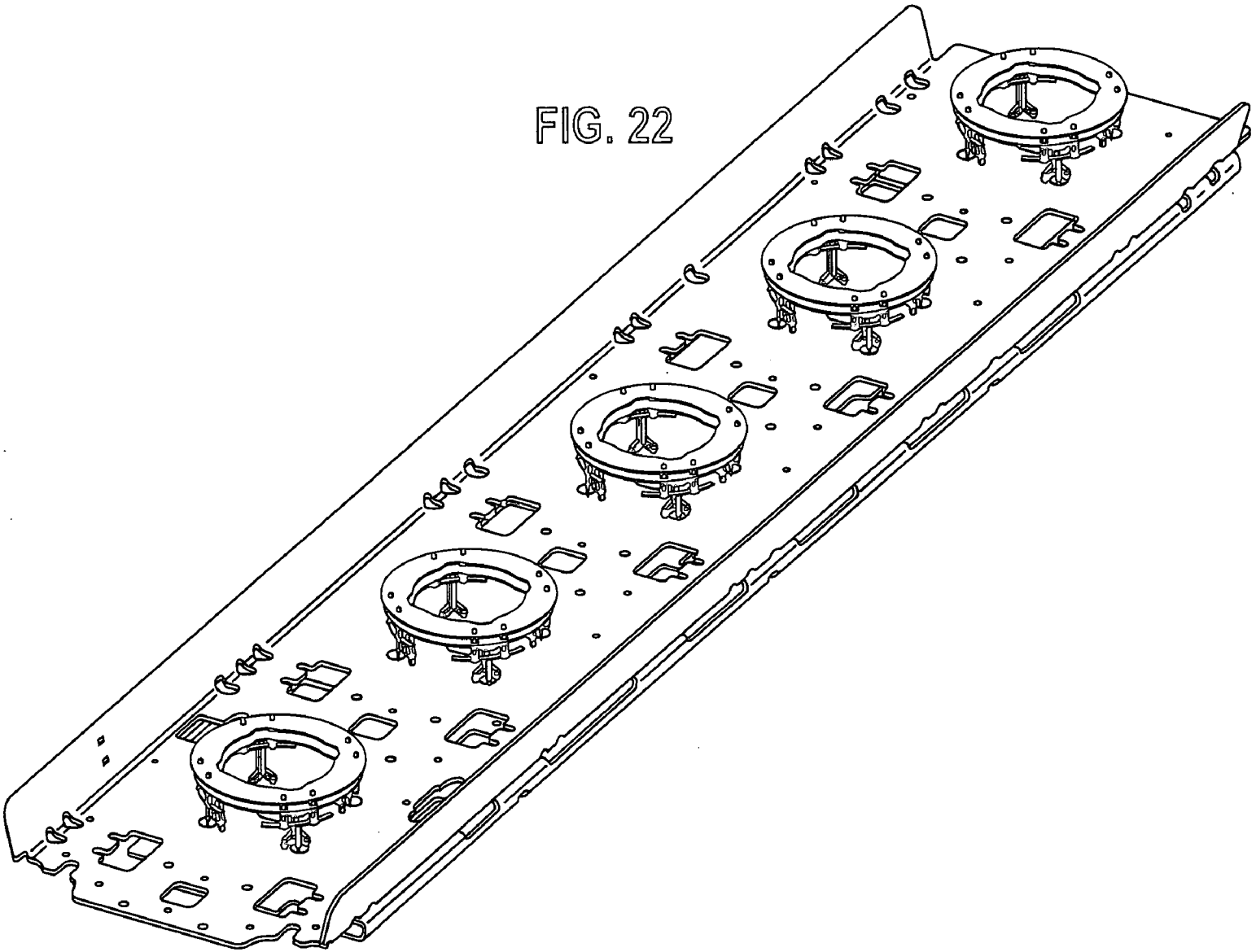
FIG. 22 shows a single band antenna.

A further alternative antenna is shown in FIG. 22. The antenna of FIG. 22 is identical to the antenna of FIG. 12, except that the antenna is a single band antenna, having only MAR radiating elements (and no high frequency CDEs). Certain features of the dual band antenna shown in FIG. 22 (for instance the shaped inner periphery of the MARs, the holes in the reflector for the CDEs) are unnecessary in a single band antenna, so may be omitted in practice.

Figure 23:
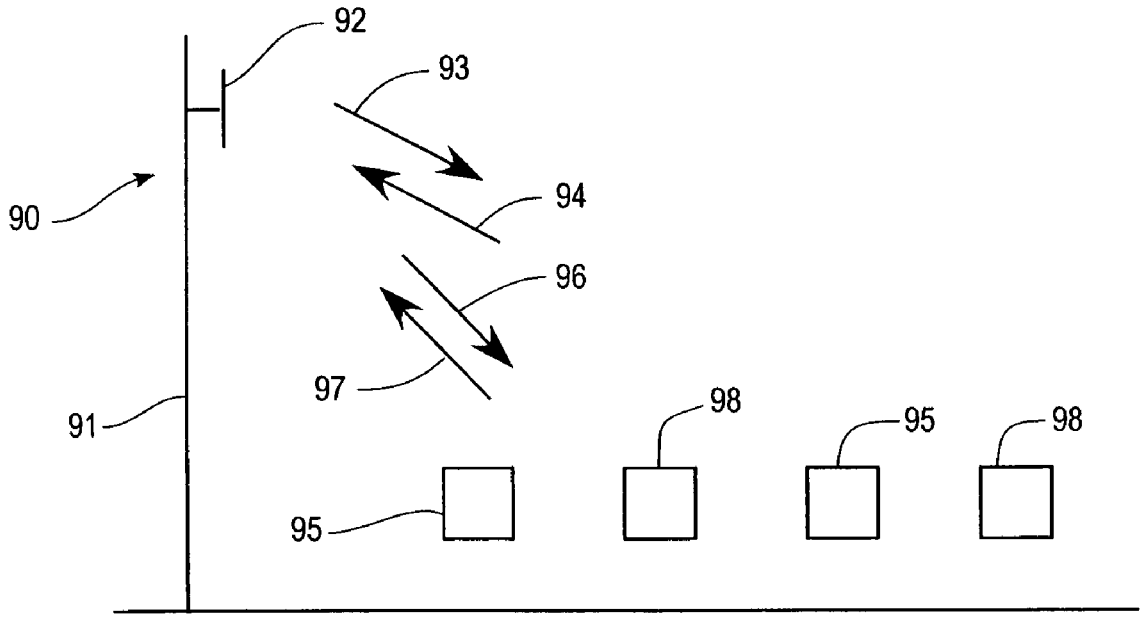
FIG. 23 shows a dual-band antenna communicating with a number of land-based mobile devices.

A typical field of use of the multiband antennas described above is shown in FIG. 23. A base station 90 includes a mast 91 and multiband antenna 92. The antenna 92 transmits downlink signals 93 and receives uplink signals 94 in a low frequency band to/from terrestrial mobile devices 95 operating in the low band. The antenna 92 also transmits downlink signals 96 and receives uplink signals 97 in a low frequency band to/from mobile devices 98 operating in the high band. The downtilt of the high band and low band beams can be varied independently.

In a preferred example the low band radiators are sufficiently broadband to be able to operate in any wavelength band between 806 and 960 MHz. For instance the low band may be 806–869 MHz, 825–894 MHz or 870–960 MHz. Similarly, the high band radiators are sufficiently broadband to be able to operate in any wavelength band between 1710 and 2170 MHz. For instance the high band may be 1710–1880 MHz, 1850–1990 MHz or 1920–2170 MHz. However it will be appreciated that other frequency bands may be employed, depending on the intended application.

The relatively compact nature of the MARs, which are operated in their lowest resonant mode ($TM_{11}$), enables the MARs to be spaced relatively closely together, compared with conventional low band radiator elements. This improves performance of the antenna, particularly when the ratio of the wavelengths for the high and low band elements is relatively high. For instance, the antenna of FIG. 12 is able to operate with a frequency ratio greater than 2.1:1. The CDEs and MARs have a spacing ratio of 2:1. In wavelength terms, the CDEs are spaced apart by 0.82 $\lambda$ and the MARs are spaced apart by 0.75 $\lambda$, at the mid-frequency of each band. Thus the ratio between the mid-frequencies is 2.187:1. At the high point of the frequency band, the CDEs are spaced apart by 0.92 $\lambda$ and the MARs are spaced apart by 0.81 $\lambda$ (the ratio between the high-point frequencies being 2.272:1).

While the present invention has been illustrated by the description of the embodiments thereof, and while the embodiments have been described in detail, it is not the intention of the Applicant to restrict or in any way limit the scope of the appended claims to such detail.

For example, the CDEs may be replaced by a patch element, or a "travelling-wave" element.

The MARs, parasitic rings 40 or single piece radiating rings 45 may be square, diamond or elliptical rings (or any other desired ring geometry), instead of circular rings. Preferably the rings are formed from a continuous loop of conductive material (which may or may not be manufactured as a single piece).

Although the radiating elements shown are dual-polarized elements, single-polarized elements may be used as an alternative. Thus for instance the MARs, or single piece radiating rings 45 may be driven by only a single pair of probes on opposite sides of the ring, as opposed to the dual-polarized configurations shown in FIGS. 1 and 12 which employ four probes.

Furthermore, although a balanced feed arrangement is shown, the elements may be driven in an unbalanced manner. Thus for instance each polarization of the MARs or the single piece rings 45 may be driven by only a single probe, instead of a pair of probes on opposite sides of the ring.

Additional advantages and modifications will readily appear to those skilled in the art. Therefore, the invention in its broader aspects is not limited to the specific details, representative apparatus and method, and illustrative examples shown and described. Accordingly, departures may be made from such details without departure from the spirit or scope of the Applicant's general inventive concept.

What is claimed is:

1. A method of communicating with a plurality of terrestrial mobile devices, the method including communicating with a first set of said devices in a low frequency band using a ring element;

communicating with a second set of said devices in a high frequency band using a high frequency element superposed with the ring element, and wherein said ring element communicates via a first beam with a first half-power beamwidth, and said high frequency element communicates via a second beam with a second half-power beamwidth which is no more than 50% different to the first beamwidth.

2. A method according to claim 1 wherein said communicating with said first and second devices is a two-way communication.

3. A method of communicating with a plurality of terrestrial mobile devices, the method including communicating with a first set of said devices in a low frequency band using a ring element; and communicating with a second set of said devices in a high frequency band using a high frequency element superposed with the ring element, wherein said ring element communicates via a first beam with a first half-power beamwidth less than 120°, and said high frequency element communicates via a second beam with a second half-power beamwidth less than 120°.

4. A method according to claim 3 wherein the second half-power beamwidth is less than 90°.

5. A multiband antenna including one or more modules, each module including a low frequency ring element, and a high frequency dipole element having an outer periphery, wherein an inner periphery of the low frequency ring element completely encloses the outer periphery of the high frequency dipole element.

6. An antenna according to claim 5 wherein the dipole element is a crossed dipole element.

7. An antenna according to claim 5, wherein the low frequency ring element has a minimum outer diameter b, a maximum inner diameter a, and the ratio b/a is less than 1.5.

8. An antenna according to claim 5 wherein the low frequency element is a dual-polarized element and the high frequency dipole element is a dual-polarized element.

9. An antenna according to claim 5 wherein the low frequency ring element is a microstrip ring element.

10. An antenna according to claim 5 wherein the high frequency dipole element and the low frequency ring element are superposed substantially concentrically.

11. An antenna according to claim 5 wherein the high frequency element has an outer periphery, and the low frequency ring element has an inner periphery which completely encloses the outer periphery of the high frequency dipole element, when viewed in plan perpendicular to the antenna.

12. A communication system including a network of antennas according to claim 5.

13. A method of communicating with a plurality of devices, the method including communicating with a first set of said devices in a low frequency band using a ring element having an inner periphery, and communicating with a second set of said devices in a high frequency band using a dipole element having an outer periphery, wherein the inner periphery of the ring element completely encloses the outer periphery of the dipole element.

14. A multiband antenna including an array of two or more modules, each module including a low frequency ring element and a high frequency element superposed with the low frequency ring element, and one or more interstitial high frequency elements located between each pair of adjacent modules in the array.

15. An antenna according to claim 14, wherein the low frequency ring element has a minimum outer diameter b, a maximum inner diameter a, and the ratio b/a is less than 1.5.

16. An antenna according to claim 14 wherein the low frequency ring element is a dual-polarized element and the high frequency element is a dual-polarized element.

17. An antenna according to claim 14 wherein the low frequency ring element is a microstrip ring element.

18. An antenna according to claim 14 wherein the high frequency element and the low frequency ring element are superposed substantially concentrically.

19. An antenna according to claim 14 wherein the high frequency element has an outer periphery, and the low frequency ring element has an inner periphery which completely encloses the outer periphery of the high frequency element, when viewed in plan perpendicular to the antenna.

20. An antenna according to claim 14 wherein the modules are arranged in a substantially straight line.

21. An antenna according to claim 14 wherein the array consists of only a single line of said modules.

22. An antenna according to claim 14 wherein the low frequency ring element has a substantially circular outer periphery.

23. An antenna according to claim 14 including:

an array of two or more primary modules spaced apart along an antenna axis, each primary module including a low frequency ring element and a high frequency element superposed with the low frequency ring element; and one or more secondary modules, each secondary module positioned between a respective adjacent pair of primary modules, and including an interstitial high frequency element.

24. A communication system including a network of antennas according to claim 14.

25. A multiband antenna including an array of two or more modules, each module including a low frequency ring element and a high frequency element superposed with the low frequency ring element, further including a parasitic ring superposed with the high frequency element.

26. A multiband antenna including one or modules, each module including a low frequency ring element having an inner periphery and a high frequency element having an outer periphery, wherein the inner periphery of low frequency ring element is non-circular and completely encloses the outer periphery of the high frequency element.

27. An antenna according to claim 26 wherein the inner periphery is formed with one or more notches which provide clearance for the high frequency element.

28. An antenna according to claim 27 wherein the inner periphery of the low frequency is substantially circular between the notches.

29. An antenna according to claim 27 wherein the one or more notches has a base and a pair of non-parallel side walls.

30. An antenna according to claim 26 wherein the low frequency ring element has two or more notches distributed regularly around its inner periphery, each notch providing clearance for a respective part of the high frequency element.

31. An antenna according to claim 26, wherein the inner periphery of the ring has a minimum diameter which is greater than a maximum diameter of the high frequency element.

32. A communication system including a network of antennas according to claim 26.

* * * * *